US012098512B2

(12) United States Patent
Hu et al.

(10) Patent No.: US 12,098,512 B2
(45) Date of Patent: Sep. 24, 2024

(54) HAUNCHED STRUCTURE-BASED STEEL SUPPORT STRUCTURE FOR FOUNDATION PIT

(71) Applicant: Dongtong Geotechnical Science and Technology Inc., Hangzhou (CN)

(72) Inventors: Qi Hu, Hangzhou (CN); Xingdi Huang, Hangzhou (CN); Xiaobing Xu, Hangzhou (CN); Huajian Fang, Hangzhou (CN); Tianming Huang, Hangzhou (CN); Haidi Zhu, Hangzhou (CN); Yiliang Deng, Hangzhou (CN); Xiang Zhu, Hangzhou (CN); Jianping Li, Hangzhou (CN); Zefeng Lou, Hangzhou (CN); Tao Wang, Hangzhou (CN)

(73) Assignee: Dongtong Geotechnical Science and Technology Inc., Hangzhou (CN)

( * ) Notice: Subject to any disclaimer, the term of this patent is extended or adjusted under 35 U.S.C. 154(b) by 211 days.

(21) Appl. No.: 17/876,294

(22) Filed: Jul. 28, 2022

(65) Prior Publication Data

US 2022/0364320 A1 Nov. 17, 2022

(30) Foreign Application Priority Data

Aug. 25, 2021 (CN) ..... 202110981061.0

(51) Int. Cl.
*E02D 17/04* (2006.01)
*E02D 17/02* (2006.01)

(52) U.S. Cl.
CPC ..... *E02D 17/04* (2013.01); *E02D 17/02* (2013.01); *E02D 2300/0029* (2013.01)

(58) Field of Classification Search
CPC .. E02D 17/02; E02D 17/04; E02D 2300/0029
See application file for complete search history.

(56) References Cited

U.S. PATENT DOCUMENTS 3,710,578 A * 1/1973 Inoue ..... E02D 17/04 405/282
4,140,427 A * 2/1979 Jackson ..... E02D 5/28 405/253

(Continued)

FOREIGN PATENT DOCUMENTS

CN 203821400 U 9/2014
CN 204112335 U 1/2015

(Continued)

*Primary Examiner* — Paola Agudelo

(57) ABSTRACT

A haunched component-based steel support structure for a foundation pit, including an enclosing purlin beam, a support beam located on an inner side of the enclosing purlin beam, and a triangular support arranged on the enclosing purlin beam. A first edge of the triangular support is fixedly arranged on the enclosing purlin beam. An end of the support beam abuts against a second edge of the triangular support to be supported on the enclosing purlin beam, and a haunched component is arranged between the enclosing purlin beam and a third edge of the triangular support. A first side of the haunched component is connected to the third edge of the triangular support, and a second side of the haunched component is connected to the enclosing purlin beam.

6 Claims, 4 Drawing Sheets

(56) References Cited

U.S. PATENT DOCUMENTS

| | | | | |
|---|---|---|---|---|
| 4,376,599 | A * | 3/1983 | Krings | E02D 17/08 405/282 |
| 4,453,863 | A * | 6/1984 | Sutton | E02D 17/08 405/282 |
| 4,464,084 | A * | 8/1984 | Wozniak | E02D 17/04 405/151 |
| 7,883,296 | B2 * | 2/2011 | Meyer | E02D 17/04 405/283 |
| 10,392,770 | B2 * | 8/2019 | Chilton | E02D 17/04 |
| 2006/0070803 | A1 * | 4/2006 | Han | E02D 17/04 182/87 |
| 2010/0054869 | A1 * | 3/2010 | Meyer | E02D 17/04 405/282 |
| 2012/0204512 | A1 * | 8/2012 | Trinko | E04G 23/024 254/133 R |
| 2014/0248093 | A1 * | 9/2014 | Breen | E02F 5/10 405/284 |
| 2019/0153693 | A1 * | 5/2019 | Hu | E02D 17/04 |
| 2020/0291597 | A1 * | 9/2020 | Wang | F16L 55/18 |

FOREIGN PATENT DOCUMENTS

| | | | |
|---|---|---|---|
| CN | 109763492 | A | 5/2019 |
| CN | 111236263 | A | 6/2020 |
| CN | 211873032 | U | 11/2020 |
| CN | 216130129 | U | 3/2022 |

* cited by examiner

HAUNCHED STRUCTURE-BASED STEEL SUPPORT STRUCTURE FOR FOUNDATION PIT

CROSS-REFERENCE TO RELATED APPLICATIONS

This application claims the benefit of priority from Chinese Patent Application No. 202110981061.0, filed on Aug. 25, 2021. The content of the aforementioned application, including any intervening amendments thereto, is incorporated herein by reference in its entirety.

TECHNICAL FIELD

This application relates to steel support structures of foundation pits, and more particularly to a haunched structure-based steel support structure for a foundation pit.

BACKGROUND

Currently, a common foundation pit steel support structure includes an enclosing purlin beam, a support beam located on the inner side of the enclosing purlin beam, and a triangular support arranged on the enclosing purlin beam, where a base side of the triangular support is fixedly arranged on the enclosing purlin beam, and an end of the support beam is supported on the enclosing purlin beam through the triangular support. In this way, the arrangement density of the support beam in the foundation pit can be reduced, which can provide a larger working space for the excavation of the foundation pit. However, the span between two adjacent triangular supports tends to increase, which will render the enclosing purlin beam prone to bending deformation, and make it adverse to the mitigation of the lateral deformation of the foundation pit.

SUMMARY

An object of this application is to provide a haunched structure-based steel support structure for a foundation pit, in which the span of the purlin between two adjacent triangular supports is shortened without increasing the number of triangular supports and the arrangement density of the support beams in the foundation pit, thereby reducing the bending deformation of the enclosing purlin beam and the lateral deformation of the foundation pit.

The technical solutions of this application are described as follows.

This application provides a haunched structure-based steel support structure for a foundation pit, comprising:

an enclosing purlin beam;

a support beam located on an inner side of the enclosing purlin beam; and a triangular support arranged on the enclosing purlin beam;

wherein a first edge of the triangular support is fixedly arranged on the enclosing purlin beam; an end of the support beam is supported on the enclosing purlin beam through the triangular support, and abuts against a second edge of the triangular support; a haunched component is arranged between the enclosing purlin beam and a third edge of the triangular support; a first side of the haunched component is connected to the second side of the triangular support; and a second side of the haunched component is connected to the enclosing purlin beam. In this application, by arranging the haunched component between the enclosing purlin beam and the third edge of the triangular support, the controlling range of the triangular support is increased, and the span of the purlin between adjacent two triangular supports is shortened, thereby reducing the bending deformation of the enclosing purlin beam and the lateral deformation of the foundation pit.

In an embodiment, the haunched component is triangular; a first edge of the haunched component is connected to the third edge of the triangular support; and a second edge of the haunched component is connected to the enclosing purlin beam. In this application, an outer edge angle (obtuse angle) formed by a third edge of the haunched component and the enclosing purlin beam is larger than the outer edge angle (obtuse angle) in the prior art that is formed by the third edge of the triangular support and the enclosing purlin beam. By enlarging the outer edge angle, the stress between the haunched component and the enclosing purlin beam is further dispersed, thereby improving the local yield resistance between the haunched component and the enclosing purlin beam.

In an embodiment, the haunched component has an integrated structure; or the haunched component is composed of two or more parts, and any adjacent two parts are boltedly connected.

This application also provides a haunched component-based steel support structure for a foundation pit, comprising:

an enclosing purlin beam;

a support beam located on an inner side of the enclosing purlin beam; and a triangular support arranged on the enclosing purlin beam;

wherein a first edge of the triangular support is fixedly arranged on the enclosing purlin beam; the support beam comprises two inclined support beams arranged in a splayed manner; an end of each of the two inclined support beams close to the enclosing purlin beam is supported on the enclosing purlin beam through the triangular support, and abuts against a second edge of the triangular support; a haunched component is arranged between the enclosing purlin beam and a third edge of the triangular support; a first side of the haunched component is connected to the third edge of the triangular support; and a second side of the haunched component is connected to the enclosing purlin beam. In this application, by arranging the haunched component between the enclosing purlin beam and the third edge of the triangular support, the controlling range of the triangular support is increased, which can reduce the span of the purlin between two adjacent triangular supports without increasing the number of triangular supports and the arrangement density of the support beam in the foundation pit, thereby reducing the bending deformation of the enclosing purlin beam and the lateral deformation of the foundation pit.

In an embodiment, the number of the triangular support is two; two triangular supports are respectively corresponding to the two inclined support beams; the number of the haunched component is two; the two triangular supports are arranged between two haunched components; the two haunched components are connected through a prestressed cable; and the prestressed cable is configured to provide a pre-tensioning force between the two haunched components. In the haunched component-based steel support structure provided herein, the two triangular supports are subjected to a horizontal shear along the enclosing purlin beam under the pressure from the soil outside the foundation pit such that a displacement of the triangular support along the enclosing purlin beam or a deformation of the connecting part between the triangular support and the enclosing purlin beam occurs during a long-term working of the steel support structure, which causes the lateral deformation of the foundation pit. Moreover, the partial enclosing purlin beam located between the two triangular supports may surfer bending and deformation under the pressure from the soil outside the foundation pit. To overcome the above defects, in this application, the two haunched components are connected through a prestressed cable to provide a pre-tensioning force between the two haunched components to offset partial horizontal shear of the two triangular supports along the enclosing purlin beam. At the same time, the prestressed cable and the bolt connecting the triangular support with the enclosing purlin beam can be used to share the horizontal shear of the two triangular supports along the enclosing purlin beam, so as to effectively reduce the lateral deformation of the foundation pit caused by the displacement of the triangular support along the enclosing purlin beam or the deformation of the connecting part between the triangular support and the enclosing purlin beam. More importantly, due to the pre-tensioning force between the two haunched components produced by the prestressed cable, the enclosing purlin beam located between the two triangular supports can form a reverse arch force toward the outside of the foundation pit, further improving the bearing capacity of the enclosing purlin beam located between the two triangular supports, so as to reduce the bending deformation of the enclosing purlin beam under the pressure from the soil outside the foundation pit.

In an embodiment, the prestressed cable comprises a plurality of prestressed cables; and one part of the plurality of prestressed cables are located above the two triangular supports, and the other part of the plurality of prestressed cables are located below the two triangular supports.

In an embodiment, the haunched component is triangular; a first edge of the haunched component is connected to the third edge of the triangular support; and a second edge of the haunched component is connected to the enclosing purlin beam. In this application, an outer edge angle (obtuse angle) formed by a third edge of the haunched component and the enclosing purlin beam is larger than the outer edge angle (obtuse angle) in the prior art that is formed by the third edge of the triangular support and the enclosing purlin beam. By enlarging the outer edge angle, the stress between the haunched component and the enclosing purlin beam is further dispersed, thereby improving the local yield resistance between the haunched component and the enclosing purlin beam.

In an embodiment, the haunched component has an integrated structure; or the haunched component is composed of two or more parts, and any adjacent two parts are boltedly connected.

In an embodiment, the two inclined support beams are arranged symmetrically.

In an embodiment, the haunched component is made of steel; and a ribbed plate is arranged in the haunched component and is configured to enhance strength of the haunched component.

Compared with the prior art, the beneficial effects of the present invention are described below.

The steel support structure provided herein can reduce the span of the purlin between two adjacent triangular supports without increasing the number of triangular supports and the arrangement density of the support beams in the foundation pit, thereby reducing the bending deformation of the enclosing purlin beam and the lateral deformation of the foundation pit.

Figure 1:
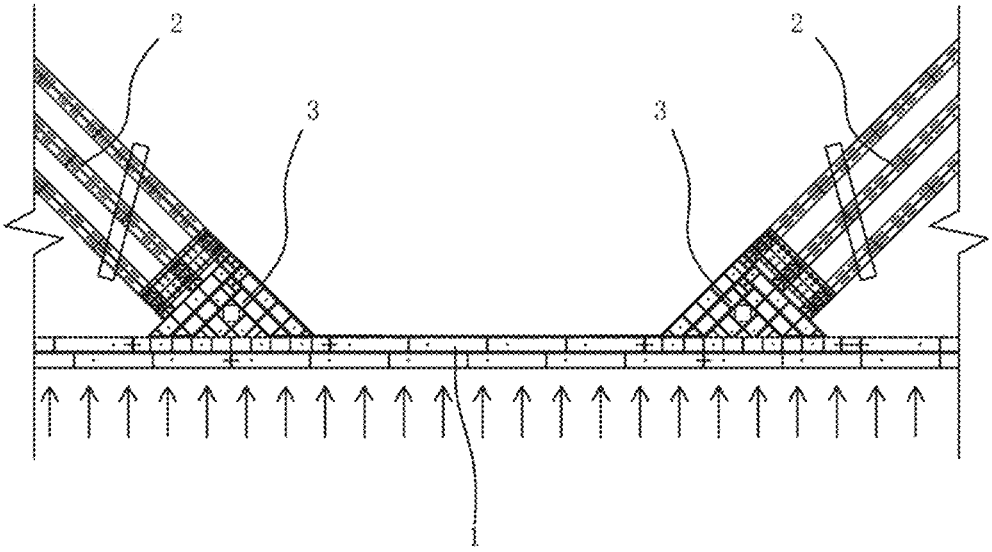
Prior Art Fig. 1
FIG. 1 is a partially structural diagram of a steel support structure for a foundation pit in the prior art.

In the drawings, 1, enclosing purlin beam; 2, support beam; 2.0, main support beam; 2.1, inclined support beam; 2.2, steel triangular component; 3, triangular support; 4, haunched component; and 5, prestressed cable.

DETAILED DESCRIPTION OF EMBODIMENTS

To make the objects, technical solutions, and advantages of the technical solutions of the present disclosure clearer, the technical solutions of the embodiments of the present disclosure will be clearly explained and illustrated below with reference to the accompanying drawings. The following embodiments are merely preferred embodiments of the present disclosure, and are not intended to limit the disclosure. Based on these embodiments, other embodiments obtained by those skilled in the art without paying creative efforts shall fall within the scope of the present disclosure.

The embodiments of this disclosure will be described below in detail with reference to the accompanying drawings. It should be understood that the same or similar reference numerals refer to the same or similar components or components with the same or similar functions throughout the disclosure. The embodiments described below are only illustrative of the technical solutions, and are not intended to limit this disclosure.

With reference to the following descriptions and accompanying drawings, the embodiments will be clearly illustrated, some specific implementations of the embodiments of this disclosure are disclosed in detail to explain the principles of this disclosure, but are not intended to limit this disclosure. It should be understood that any changes, modifications and replacements made by those skilled in the art without departing from the spirit of the disclosure shall fall within the scope of the disclosure defined by the appended claims.

It should be understood that the indicative terms used herein (such as "thickness", "upper", "lower", "horizontal", "top", "bottom", "inner", "outer", "circumferential") indicate orientation or positional relationship shown in the drawings, which are intended to describe the present disclosure and simplify the description, rather than indicating or implying that the indicated devices or elements must have a particular orientation, are constructed and operated in a specific orientation, and are thus not to be considered as limitations on the present disclosure. In the description of the present disclosure, the term "multiple" means at least two, for example, two, three, or more. Unless otherwise specifically defined, the term "a plurality of" means one or more.

In the present disclosure, unless otherwise specifically defined, terms (such as "arrangement", "connection", "joint", and "fixed") should be understood broadly, such as fixed connections, detachable connections, integrated connections, mechanical connections, electrical connections, communications with each other, direct connections, indirectly connections by using intermediate mediums, communications inside two elements, and an interactive relationship between two elements. For one of ordinary skill in the art, the specific meanings of the above terms in the present disclosure may be understood according to specific situations.

FIG. 1 is a partially structural diagram of a steel support structure for a foundation pit in the prior art.

Embodiment 1

Figure 2:
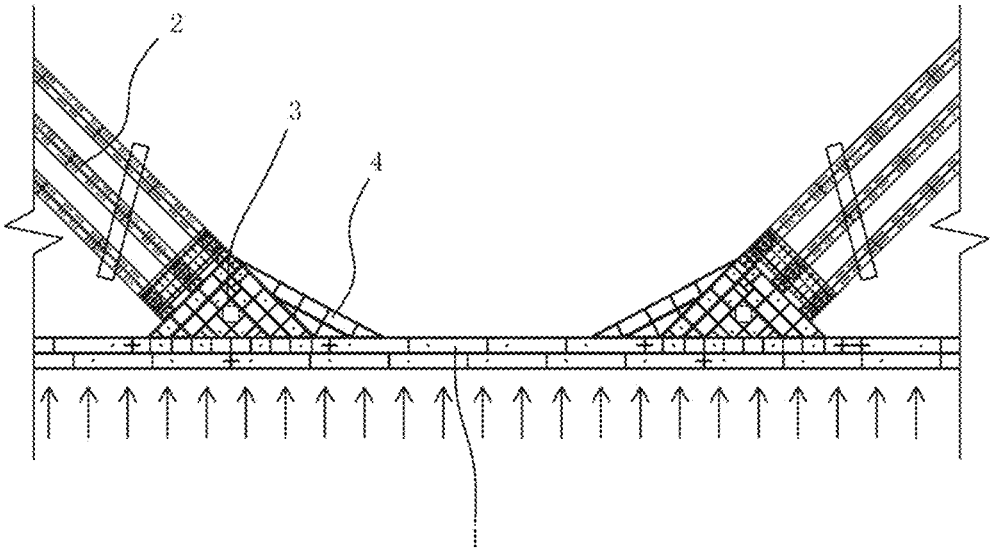
FIG. 2 is a partially structural diagram of a haunched component-based steel support structure for a foundation pit according to Embodiment 1 of this disclosure.
Figure 3:
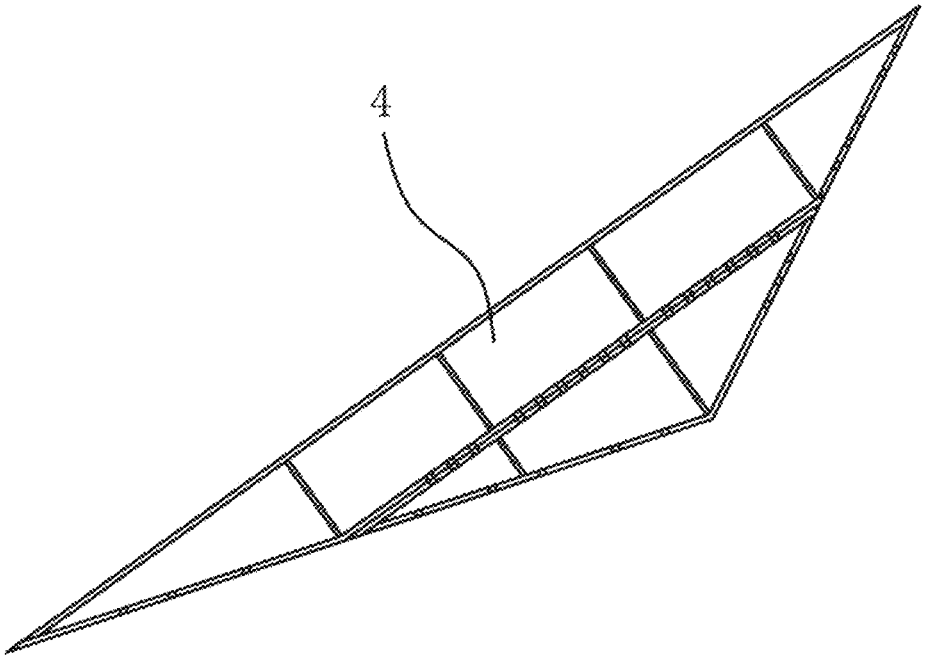
FIG. 3 is a structural diagram of the haunched component according to Embodiment 1 of this disclosure.

Referring to FIGS. 2-3, a haunched structure-based steel support structure for a foundation pit is provided, which includes an enclosing purlin beam 1, a support beam 2 located on an inner side of the enclosing purlin beam 1, and a triangular support 3 arranged on the enclosing purlin beam. A first edge of the triangular support is fixedly arranged on the enclosing purlin beam 1. Preferably, the first edge of the triangular support is fixedly arranged on the enclosing purlin beam 1 through bolts. An end of the support beam 2 is supported on the enclosing purlin beam 1 through the triangular support 3. For example, two ends of the support beam 2 are respectively supported on the enclosing purlin beam 1 though the triangular support 3. Or one end of the support beam 2 is supported on the enclosing purlin beam 1 though the triangular support 3, and the other end of the support beam 2 abuts against the enclosing purlin beam 1. The end of the support beam 2 abuts against a second edge of the triangular support 3, and a haunched component 4 is arranged between the enclosing purlin beam 1 and a third side of the triangular support 3. A first side of the haunched component 4 is connected to the third edge of the triangular support 3, and a second side of the haunched component 4 is connected to the enclosing purlin beam 1.

In this embodiment, the first side of the haunched component 4 is connected to the third edge of the triangular support 3 through bolts, and the second side of the haunched component 4 is connected to the enclosing purlin beam 1 through bolts. In other embodiments, the first side of the haunched component 4 is connected to the third edge of the triangular support 3 by welding, and the second side of the haunched component 4 is connected to the enclosing purlin beam 1 by welding.

In this embodiment, the haunched component 4 is made of steel and has an integrated structure; or the haunched component 4 is composed of two or more parts, and any adjacent two parts are boltedly connected. A ribbed plate is arranged in the haunched component 4 for enhancing strength of the haunched component 4.

In this embodiment, the support beam 2, the triangular support 3, and the enclosing purlin beam 1 are both made of steel.

In this embodiment, by arranging the haunched component between the enclosing purlin beam and the third edge of the triangular support, the controlling range of the triangular support is increased, which can reduce the span of the purlin between two adjacent triangular supports without increasing the number of triangular supports and the arrangement density of the support beam in the foundation pit, thereby reducing the bending deformation of the enclosing purlin beam and the lateral deformation of the foundation pit.

Furthermore, as illustrated in FIGS. 2-3, the haunched component 4 is triangular. A first edge of the haunched component 4 is connected to the third edge of the triangular support 3, and a second edge of the haunched component 4 is connected to the enclosing purlin beam 1. In this application, an outer edge angle (obtuse angle) formed by a third edge of the haunched component and the enclosing purlin beam is larger than the outer edge angle (obtuse angle) in the prior art that is formed by the third edge of the triangular support and the enclosing purlin beam. By enlarging the outer edge angle, the stress between the haunched component and the enclosing purlin beam can be further dispersed, thereby improving the local yield resistance between the haunched component and the enclosing purlin beam.

Embodiment 2

Figure 4:
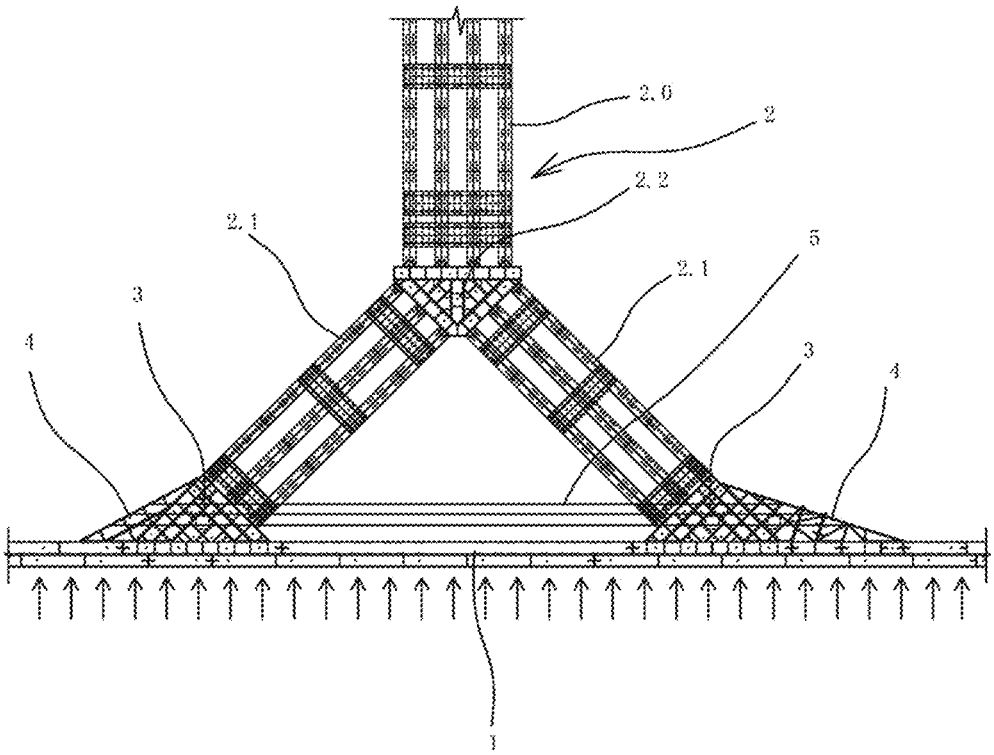
FIG. 4 is a partially structural diagram of a haunched component-based-based steel support structure for a foundation pit according to Embodiment 2 of this disclosure.

As shown in FIG. 4, a haunched component-based steel support structure for a foundation pit is illustrated, which includes an enclosing purlin beam 1, a support beam 2 located on an inner side of the enclosing purlin beam 1, and a triangular support 3 arranged on the enclosing purlin beam 1. A first edge of the triangular support 3 is fixedly arranged on the enclosing purlin beam 1. Preferably, the first edge of the triangular support is fixedly arranged on the enclosing purlin beam 1 through bolts. The support beam 2 includes two inclined support beams 2.1 arranged in a splayed manner. In this embodiment, the inclined support beams 2.1 are arranged symmetrically. An end of each of the two inclined support beams 2.1 close to the enclosing purlin beam 1 is supported on the enclosing purlin beam 1 through the triangular support 3 and abuts against a second edge of the triangular support 3, and a haunched component 4 is arranged between the enclosing purlin beam 1 and a third edge of the triangular support 3. A first side of the haunched component 4 is connected to the third edge of the triangular support 3, and a second side of the haunched component 4 is connected to the enclosing purlin beam 1.

In this embodiment, the first side of the haunched component 4 is connected to the third edge of the triangular support 3 through bolts, and the second side of the haunched component 4 is connected to the enclosing purlin beam 1 through bolts. In other embodiments, the first side of the haunched component 4 is connected to the third edge of the triangular support 3 by welding, and the second side of the haunched component 4 is connected to the enclosing purlin beam 1 by welding.

In this embodiment, the haunched component 4 is made of steel and has an integrated structure; or the haunched component 4 is composed of two or more parts, and any adjacent two parts are boltedly connected. A ribbed plate is arranged in the haunched component 4 for enhancing strength of the haunched component 4.

In this embodiment, the support beam 2, the triangular support 3, and the enclosing purlin beam 1 are both made of steel.

In this embodiment, by arranging the haunched component between the enclosing purlin beam and the third edge of the triangular support, the controlling range of the triangular support is increased, which can reduce the span of the purlin between two adjacent triangular supports without increasing the number of triangular supports and the arrangement density of the support beam in the foundation pit, thereby reducing the bending deformation of the enclosing purlin beam and the lateral deformation of the foundation pit.

Specifically, as shown in FIG. 4, the support beam 2 also includes a main support beam 2.0 and a steel triangular component 2.2 installed at an end of the main support beam 2.0. A first edge of the steel triangular component 2.2 is arranged at the end of the main support beam 2.0 through bolts. The two inclined support beams 2.1 are both arranged at the end of the main support beam 2.0 in a splayed manner. One end of each of the two inclined support beams 2.1 close to the enclosing purlin beam 1 is supported on the enclosing purlin beam 1 through the triangular support 3, the other end of one of the two inclined support beams 2.1 close to the main support beam 2.0 abuts against a second edge of the steel triangular component 2.2, and the other end of the other of the two inclined support beams 2.1 close to the main support beam 2.0 abuts against a third edge of the steel triangular component 2.2.

Furthermore, as shown in FIG. 4, the number of the triangular support 3 is two. Two triangular supports 3 are respectively corresponding to the two inclined support beams 2.1. The number of the haunched component 4 is two. The two triangular supports 3 are arranged between two haunched components 4. The two haunched components 4 are connected through a prestressed cable 5. The prestressed cable 5 is configured to provide a pre-tensioning force between the two haunched components 4. In this example, the prestressed cable 5 is a steel cable. In the steel support structure of a foundation pit, the two triangular supports are subjected to a horizontal shear along the enclosing purlin beam under the pressure from the soil outside the foundation pit such that a displacement of the triangular support along the enclosing purlin beam or a deformation of the connecting part between the triangular support and the enclosing purlin beam occurs during a long-term working of the steel support structure, which causes the lateral deformation of the foundation pit. Moreover, the partial enclosing purlin beam located between the two triangular supports may surfer bending and deformation under the pressure from the soil outside the foundation pit. To overcome the above defects, in this application, the two haunched components are connected through a prestressed cable to provide a pre-tensioning force between the two haunched components to offset partial horizontal shear of the two triangular supports along the enclosing purlin beam. At the same time, the prestressed cable and the bolt connecting the triangular support with the enclosing purlin beam can be used to share the horizontal shear of the two triangular supports along the enclosing purlin beam, so as to effectively reduce the lateral deformation of the foundation pit caused by the displacement of the triangular support along the enclosing purlin beam or the deformation of the connecting part between the triangular support and the enclosing purlin beam. More importantly, due to the pre-tensioning force between the two haunched components produced by the prestressed cable, the enclosing purlin beam located between the two triangular supports can form a reverse arch force toward the outside of the foundation pit, further improving the bearing capacity of the enclosing purlin beam located between the two triangular supports, so as to reduce the bending deformation of the enclosing purlin beam under the pressure from the soil outside the foundation pit.

In this embodiment, as shown in FIG. 4, the prestressed cable 5 includes a plurality of prestressed cables. One part of the plurality of prestressed cables 4 are located above the two triangular supports, and the other part of the plurality of prestressed cables 5 are located below the two triangular supports.

Furthermore, the haunched component 4 is triangular. A first edge of the haunched component 4 is connected to the third edge of the triangular support 3, and a second edge of the haunched component 4 is connected to the enclosing purlin beam 1. In this application, an outer edge angle (obtuse angle) formed by a third edge of the haunched component 4 and the enclosing purlin beam 1 is larger than the outer edge angle (obtuse angle) in the prior art that is formed by the third edge of the triangular support 3 and the enclosing purlin beam 1. By enlarging the outer edge angle, the stress between the haunched component 4 and the enclosing purlin beam 1 is further dispersed, thereby improving the local yield resistance between the haunched component 4 and the enclosing purlin beam 1.

The above-mentioned embodiments are merely preferred embodiments, which are not intended to limit the present disclosure. It should be noted that any modifications, changes and replacements made by those skilled in the art without departing from the spirit of the disclosure shall fall within the scope of the present disclosure defined by the appended claims.

What is claimed is:

1. A haunched component-based steel support structure for a foundation pit, comprising:

an enclosing purlin beam;

a support beam located on an inner side of the enclosing purlin beam; and two triangular supports arranged on the enclosing purlin beam;

wherein a first edge of each of the two triangular supports is fixedly arranged on the enclosing purlin beam; the support beam comprises two inclined support beams arranged in a splayed manner; the two triangular supports correspond to the two inclined support beams, respectively; an end of each of the two inclined support beams close to the enclosing purlin beam is supported on the enclosing purlin beam through one of the two triangular supports, and abuts against a second edge of one of the two triangular supports; each of two haunched components is arranged between the enclosing purlin beam and a third edge of one of the two triangular supports; a first side of each of the two haunched components is connected to the third edge of one of the two triangular supports; and a second side of each of the two haunched components is connected to the enclosing purlin beam; and the two triangular supports are arranged between two haunched components; the two haunched components are connected through a prestressed cable; and the prestressed cable is configured to provide a pre-tensioning force between the two haunched components.

2. The haunched component-based steel support structure of claim 1, wherein the prestressed cable comprises a plurality of prestressed cables; and one part of the plurality of prestressed cables are located above the two triangular supports, and the other part of the plurality of prestressed cables are located below the two triangular supports.

3. The haunched component-based steel support structure of claim 1, wherein each of the two haunched components is triangular.

4. The haunched component-based steel support structure of claim 1, wherein each of the two haunched components has an integrated structure; or each of the two haunched components is composed of two or more parts, and any adjacent two parts are boltedly connected.

5. The haunched component-based steel support structure of claim 1, wherein the two inclined support beams are arranged symmetrically.

6. The haunched component-based steel support structure of claim 1, wherein the two haunched components are made of steel; and a ribbed plate is arranged in each of the two haunched components to enhance strength of the two haunched components.

* * * * *